US012741777B2

(12) United States Patent
Kobayashi et al.

(10) Patent No.: US 12,741,777 B2
(45) Date of Patent: Sep. 22, 2026

(54) DRAWN AND IRONED CAN MADE OF RESIN-COATED ALUMINUM ALLOY

(71) Applicants: TOYO SEIKAN GROUP HOLDINGS, LTD., Tokyo (JP); TOYO SEIKAN CO., LTD., Tokyo (JP)

(72) Inventors: Tomokazu Kobayashi, Tokyo (JP); Tomohiko Nakamura, Kanagawa (JP)

(73) Assignees: TOYO SEIKAN GROUP HOLDINGS, LTD., Tokyo (JP); TOYO SEIKAN CO., LTD., Tokyo (JP)

( * ) Notice: Subject to any disclaimer, the term of this patent is extended or adjusted under 35 U.S.C. 154(b) by 360 days.

(21) Appl. No.: 18/426,873

(22) Filed: Jan. 30, 2024

(65) Prior Publication Data

US 2024/0308721 A1 Sep. 19, 2024

Related U.S. Application Data

(63) Continuation of application No. PCT/JP2022/033443, filed on Sep. 6, 2022.

(30) Foreign Application Priority Data

Nov. 9, 2021 (JP) ..... 2021-182585

(51) Int. Cl.
*B65D 1/16* (2006.01)

(52) U.S. Cl.
CPC ..... *B65D 1/165* (2013.01)

(58) Field of Classification Search
CPC . B65D 1/165; B65D 1/16; B65D 1/14; B65D 1/12; B65D 11/26; B65D 11/24;
(Continued)

(56) References Cited

U.S. PATENT DOCUMENTS

2009/0217729 A1 9/2009 Kojima et al.
2022/0347736 A1* 11/2022 Ross ..... B21D 51/2615
2023/0035259 A1* 2/2023 Whittaker ..... B65D 17/4012

FOREIGN PATENT DOCUMENTS

CN 101242917 A 8/2018
CN 110997174 A 4/2020
(Continued)

OTHER PUBLICATIONS

ISR and Written Opinion dated Oct. 12, 2022 with English Translation.

(Continued)

*Primary Examiner* — Robert J Hicks

(74) *Attorney, Agent, or Firm* — BACON & THOMAS, PLLC

(57) ABSTRACT

A drawn and ironed can made of resin-coated aluminum alloy includes a can body having a bottomed cylindrical shape. The can body includes a can bottom and a can barrel having a cylindrical shape. A height of the can body from a grounded part of the can bottom to an upper end of the can barrel is 151 mm to 160 mm. An outer diameter of the can barrel is 45 mm to 59 mm. The can barrel includes a tapered part formed in at least part of an area between 80 mm to 140 mm from the grounded part of the can bottom to the upper end of the can barrel. A plate thickness of the can barrel gradually increases inside the can barrel in the tapered part. An angle of the tapered part with respect to the can axis is 50 seconds to 1 minute and 30 seconds.

3 Claims, 6 Drawing Sheets

(58) Field of Classification Search
CPC ..... B65D 11/22; B21D 51/32; B21D 51/30; B21D 51/2653
USPC ..... 220/608, 606, 605, 604; 413/6, 4, 3, 2
See application file for complete search history.

(56) References Cited

FOREIGN PATENT DOCUMENTS

| | | | |
|---|---|---|---|
| CN | 113557199 | A | 10/2021 |
| EP | 3663013 | A1 | 6/2020 |
| EP | 3939901 | A1 | 1/2022 |
| JP | S60-133 | B2 | 1/1985 |
| JP | 7-267237 | A | 10/1995 |
| JP | 2004042965 | A | 2/2004 |
| JP | 2010-075932 | A | 4/2010 |
| JP | 2018-099710 | A | 6/2018 |
| JP | 2019-025541 | A | 2/2019 |
| JP | 2019-137450 | A | 8/2019 |
| JP | 2021-46227 | A | 3/2021 |
| TW | 202126544 | A | 7/2021 |
| WO | WO2020/184200 | A1 | 9/2020 |

OTHER PUBLICATIONS

Notice of Reasons for Refusal issued in corresponding Japanese Patent Appln. No. 2021-182585 dated Oct. 27, 2025 with machine translation.
Office Action issued in corresponding CN Patent Appln. No. 202280051957.1 with machine English translation.
First Office Action issued Dec. 30, 2025 in corresponding Taiwanese Patent Appln. No. 111139891, with machine translation.

* cited by examiner

ENLARGED VIEW OF A

ENLARGED VIEW OF B

| | Angle of Tapered Part | B.D. [mm] | Outer Diameter of Can Barrel [mm] | Molding Speed [cpm] | Original Plate Thickness [mm] | Cracking of Can Barrel (Drawing) | Cracking of Can Barrel (Redrawing) |
|---|---|---|---|---|---|---|---|
| Comp. Ex. 1-1 | 30s | 143.0 | 57.2 | 300 | 0.22 | Yes | Yes |
| | | | | | 0.23 | Yes | Yes |
| Comp. Ex. 1-2 | 40s | 143.0 | 57.2 | 300 | 0.22 | No | Yes |
| | | | | | 0.23 | No | No |
| Comp. Ex. 1-3 | 50s | 143.0 | 57.2 | 300 | 0.22 | No | No |
| | | | | | 0.23 | No | No |
| Comp. Ex. 1-4 | 1m | 143.0 | 57.2 | 300 | 0.22 | No | No |
| | | | | | 0.23 | No | No |
| Comp. Ex. 1-5 | 1m 10s | 143.0 | 57.2 | 300 | 0.22 | No | No |
| | | | | | 0.23 | No | No |
| Comp. Ex. 1-6 | 1m 20s | 143.0 | 57.2 | 300 | 0.22 | No | No |
| | | | | | 0.23 | No | No |
| Comp. Ex. 1-7 | 1m 30s | 143.0 | 57.2 | 300 | 0.22 | No | No |
| | | | | | 0.23 | No | No |
| Comp. Ex. 1-8 | 1m 40s | 143.0 | 57.2 | 300 | 0.22 | No | Yes |
| | | | | | 0.23 | No | Yes |
| Comp. Ex. 1-9 | 1m 50s | 143.0 | 57.2 | 300 | 0.22 | Yes | Yes |
| | | | | | 0.23 | No | Yes |

*FIG. 5*

| | Angle of Tapered Part | B.D. [mm] | Outer Diameter of Can Barrel [mm] | Molding Speed [cpm] | Original Plate Thickness [mm] | Cracking of Can Barrel (Drawing) | Cracking of Can Barrel (Redrawing) |
|---|---|---|---|---|---|---|---|
| Comp. Ex. 2-1 | 30s | 143.0 | 57.4 | 300 | 0.22 | Yes | Yes |
| | | | | | 0.23 | Yes | Yes |
| Comp. Ex. 2-2 | 40s | 143.0 | 57.4 | 300 | 0.22 | Yes | Yes |
| | | | | | 0.23 | No | Yes |
| Comp. Ex. 2-3 | 50s | 143.0 | 57.4 | 300 | 0.22 | No | No |
| | | | | | 0.23 | No | No |
| Comp. Ex. 2-4 | 1m | 143.0 | 57.4 | 300 | 0.22 | No | No |
| | | | | | 0.23 | No | No |
| Comp. Ex. 2-5 | 1m 10s | 143.0 | 57.4 | 300 | 0.22 | No | No |
| | | | | | 0.23 | No | No |
| Comp. Ex. 2-6 | 1m 20s | 143.0 | 57.4 | 300 | 0.22 | No | No |
| | | | | | 0.23 | No | No |
| Comp. Ex. 2-7 | 1m 30s | 143.0 | 57.4 | 300 | 0.22 | No | No |
| | | | | | 0.23 | No | No |
| Comp. Ex. 2-8 | 1m 40s | 143.0 | 57.4 | 300 | 0.22 | No | Yes |
| | | | | | 0.23 | No | Yes |
| Comp. Ex. 2-9 | 1m 50s | 143.0 | 57.4 | 300 | 0.22 | Yes | Yes |
| | | | | | 0.23 | No | Yes |

*FIG. 6*

DRAWN AND IRONED CAN MADE OF RESIN-COATED ALUMINUM ALLOY

CROSS-REFERENCE TO RELATED APPLICATIONS

The present application is a continuation application of PCT international application No. PCT/JP2022/033443 filed on Sep. 6, 2022 which claims priority from Japanese Patent Application No. 2021-182585 filed on Nov. 9, 2021, and the entire contents of which are hereby incorporated by reference.

BACKGROUND

1. Technical Field

The present invention relates to a drawn and ironed can made of resin-coated aluminum alloy.

2. Related Art

There has been known a drawn and ironed can made of resin-coated aluminum alloy (two-piece can) as a container filled with contents such as beverage. The drawn and ironed can made of resin-coated aluminum alloy is obtained by integrally molding the can barrel and the can bottom by, for example, the DI (drawing and ironing) process.

In the DI process, first, a cupping and pressing step is performed to punch a circular plate out of a metal plate and draw the circular plate, and therefore to mold a shallow cup material. Next, a body making step is performed to redraw the shallow cup material by moving a punch while the can material is pressed onto a redrawing die, and therefore to mold a deeper cup. After that, the punch is further moved, and the cup is passed through a molding die and ironed to gradually reduce the thickness of the side wall of the cup to form a bottomed cylindrical can. Next, the can is stripped from the punch by fingers and pulled out. See, for example, Japanese Examined Patent Application Publication No. S60-133. The entire contents of this disclosure are hereby incorporated by reference.

In the above-described molding process, a drawn and ironed can made of aluminum alloy which is not coated with resin is molded while the can or die is directly sprayed with a lubricant. On the other hand, the drawn and ironed can made of resin-coated aluminum alloy is molded without using a lubricant (coolant), because the resin coating serves as a lubricant. See, for example, Japanese Patent No. 2010-75932. The entire contents of this disclosure are hereby incorporated by reference.

SUMMARY

An aspect of the present invention provides a drawn and ironed can made of resin-coated aluminum alloy including a can body having a bottomed cylindrical shape. The can body includes: a can bottom; and a can barrel having a cylindrical shape around a can axis and extending from an outer circumference of the can bottom along the can axis. A height of the can body from a grounded part of the can bottom to an upper end of the can barrel is 151 mm to 160 mm. An outer diameter of the can barrel is 45 mm to 59 mm. The can barrel includes a tapered part formed in at least part of an area between 80 mm to 140 mm from the grounded part of the can bottom to the upper end of the can barrel. A plate thickness of the can barrel gradually increases inside the can barrel in the tapered part. An angle of the tapered part with respect to the can axis is 50 seconds to 1 minute and 30 seconds.

BRIEF DESCRIPTION OF THE DRAWINGS

FIG. 5 is a table illustrating a result when the can body is molded with various angles of a tapered part of the drawn and ironed can made of resin-coated aluminum alloy according to an embodiment of the invention; and FIG. 6 is a table illustrating a result when the can body is molded with various angles of the tapered part of the drawn and ironed can made of resin-coated aluminum alloy according to an embodiment of the invention.

DETAILED DESCRIPTION

As described above, the molding process of the drawn and ironed can made of resin coated aluminum alloy does not use a lubricant, and therefore a large force may be required to pull a can out of the punch depending on conditions such as the temperature of the punch.

Incidentally, in recent years, a slim two-piece can having a smaller diameter (for example, 204 diameter) has been increasingly popular because of its stylish design, instead of a general two-piece can (211 diameter) containing beer and so forth. Moreover, the plate thickness of the can barrel has been reducing because of a request for resource saving.

In the case of the slim can having a small diameter, the degree of elongation is large in the height direction of the can. Therefore, the length of the can adhering to the punch is long relative to the unit length for which the fingers of the stripper hang on the opening end of the can, during the stripping in the body making step. As a result, while the molding is performed at a high speed (for example, 300 cans per minute), the opening end of the can cannot bear the force of the stripping, and consequently the can barrel may crack. The smaller the plate thickness of the can barrel is, the easier it is to crack the can barrel.

The present invention has been achieved considering the above-described circumstances to address the above-described problems. It is therefore an object of the invention to prevent the can barrel from cracking during the stripping.

Hereinafter, an embodiment of the invention will be described with reference to the drawings. In the description below, the same reference numbers indicate the same functional sections, and therefore repeated description for each of the drawings is omitted.

Figure 1:
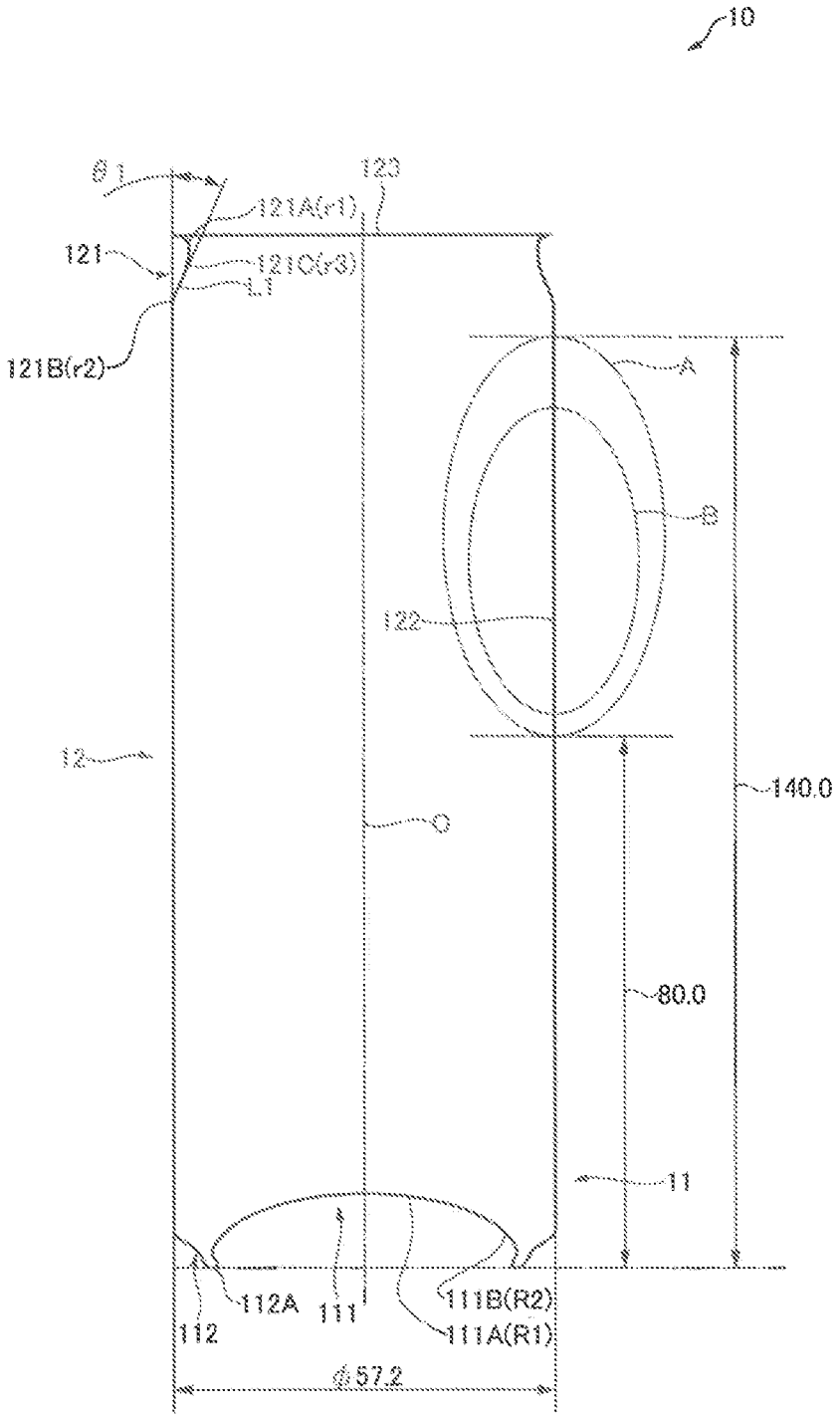
FIG. 1 is a vertical cross-sectional view along a can axis of a drawn and ironed can made of resin-coated aluminum alloy according to an embodiment of the invention.

FIG. 1 is a vertical cross-sectional view along a can axis O of a drawn and ironed can made of resin-coated aluminum alloy according to an embodiment of the invention, which schematically illustrates the drawn and ironed can made of resin-coated aluminum alloy. Here, FIG. 1 is a diagram illustrating the shape of the cross section without the plate thickness of the can body. As illustrated in FIG. 1, a drawn and ironed can made of resin-coated aluminum alloy 1 includes a can body 10 having a bottomed cylindrical shape.

The can body 10 is made of resin-coated aluminum alloy. The resin-coated aluminum alloy includes, for example, outer coating resin which forms the outer surface of the can body 10, inner coating resin which forms the inner surface of the can body 10, and aluminum alloy provided between the outer coating resin and the inner coating resin.

The can body 10 includes a can bottom 11, and a can barrel 12 having a cylindrical shape around a can axis O and extending from the outer circumference of the can bottom 11 along the can axis O. The bottomed cylindrical shape of the can body 10 is formed by the can bottom 11 and the can barrel 12. The can bottom 11 and the can body 12 have the same shape along the entire circumference around the can axis O. The can body 10 is obtained by: punching a circular plate out of a plate material made of resin-coated aluminum alloy; drawing the circular plate to mold a bottomed cylindrical cup member; redrawing and ironing the cup member to integrally mold the can bottom 11 and the can barrel 12; and trimming, necking and flanging the opening end of the can barrel 12.

The height of the can body 10 from the grounded part (described later) of the can bottom 11 to the upper end of the can barrel 12 is 151 mm to 160 mm. With the example illustrated in FIG. 1, the height is 155.0 mm. The outer diameter of the can barrel 12 is 45 mm to 59 mm. With the example illustrated in FIG. 1, the outer diameter is 57.2 mm.

The can bottom 11 includes a dome part 111 and an annular convex part 112. The dome part 111 is provided in the center of the can bottom 11, and has a concave curved surface like a dome which is concave into the inside of the can barrel 12 along the direction of the can axis O. With the example illustrated in FIG. 1, the dome part 111 includes a first curved surface 111A located in the center and having a radius of curvature R1, and a second curved surface 111B located around the first curved surface and having a radius of curvature R2 different from the radius of curvature R1. The dome part 111 may include a plurality of curved surfaces having different radius of curvatures as the example illustrated in FIG. 1, or may include one curved surface having a radius of curvature. Otherwise, a well-known dome shape may be applicable.

In a predetermined region of the dome part 111 including a point on the can axis O, it is preferred that the thickness of the outer surface coating resin is 0.008 mm to 0.015 mm, the thickness of the aluminum alloy is 0.18 mm to 0.24 mm, and the thickness of the inner surface coating resin is 0.010 mm to 0.020 mm.

The annular convex part 112 is formed on the outer circumference of the dome part 111 to annularly protrude to the outside of the can barrel 12 along the can axis direction, and includes a grounded part 112A. When the can body 10 is placed on a horizontal surface, the grounded part 112A contacts the horizontal surface to support the can body 10. In the vertical cross-sectional view of FIG. 1, the tip of the annular convex part 112 may bend to the inside of the can barrel 12 in the radial direction. That is, bottom reforming as the example illustrated in FIG. 1 is applied, and therefore it is possible to improve the strength of the can bottom 11.

The can barrel 12 has a cylindrical shape around the can axis O and extends from the outer circumference of the can bottom 11 along the can axis O. The can barrel 12 includes a neck 121 provided in the upper end, and a tapered part 122 provided between the upper end and the lower end.

The neck 121 is formed such that the outer diameter of the can barrel 12 is gradually decreased toward the top of the can barrel along the can axis O. A can lid (not illustrated) having a diameter smaller than that of the can barrel 12 is provided in the neck 121. Here, with the example illustrated in FIG. 1, the minimum outer diameter of the neck 121 is 52.4 mm.

The neck 121 includes a concave curved surface 121A formed on the upper end to be concave toward the outside in the radial direction and having a radius of curvature r1, a convex curved surface 121B formed on the lower end to be convex toward the outside in the radial direction and having a radius of curvature r2, and a concave curved surface 121C formed between the upper end and the lower end to be concave toward the outside in the radial direction and having a radius of curvature r3.

With the example illustrated in FIG. 1, the radius of curvature r1 is 1.5 mm, the radius of curvature r2 is 5.0 mm, and the radius of curvature r3 is 10.0 mm. However, the values of the radius of curvatures are merely an example, and are by no means limiting. In addition, it is preferred that an angle θ1 formed between a straight line L1 connecting the convex curved surface 121B to the concave curved surface 121C and the straight line parallel to the can axis O is smaller than 27 degrees. With the example illustrated in FIG. 1, the angle is 24 degrees.

A flange 123 is formed on the opening end of the can body 10, that is, on the upper end of the neck 121. With the example illustrated in FIG. 1, the distance from the upper end of the flange 123 to the lower end of the neck 121 along the direction of the can axis O is 11 mm.

Figure 2:
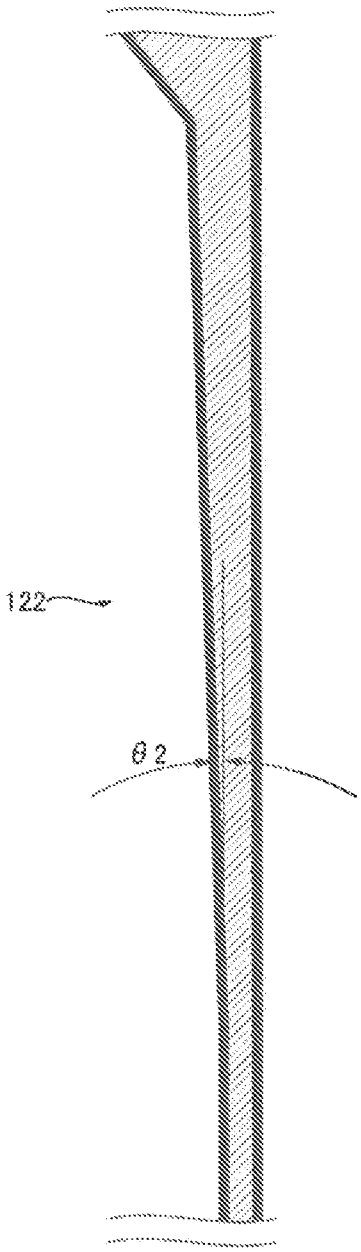
FIG. 2 is an enlarged cross-sectional view illustrating area A of the drawn and ironed can made of resin-coated aluminum alloy of FIG. 1 according to an embodiment of the invention.
Figure 3:
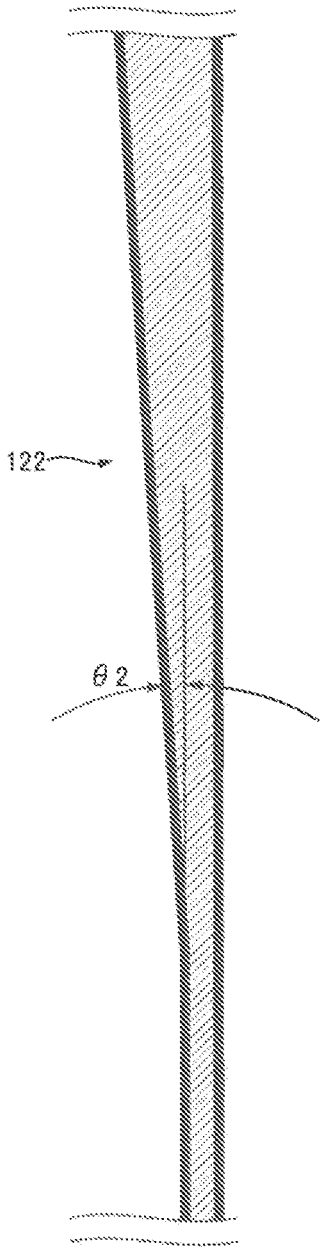
FIG. 3 is an enlarged cross-sectional view illustrating area B of the drawn and ironed can made of resin-coated aluminum alloy of FIG. 1 according to an embodiment of the invention.

FIG. 2 and FIG. 3 are enlarged views illustrating the tapered part 122. FIG. 2 is an enlarged view illustrating area A of FIG. 1, and FIG. 3 is an enlarged view illustrating area B of FIG. 1. Here, the magnification of FIG. 3 is higher than that of FIG. 2.

To be more specific, the tapered part 122 is provided at a position between 80 mm and 140 mm from the grounded part 112A (area A of FIG. 1) of the can bottom 11 to the upper end of the can barrel 12. As illustrated in FIG. 2 and FIG. 3, in at least part of the area A of the tapered part 122 of the FIG. 1, the plate thickness of the can barrel 12 is gradually increased inside the can barrel 12 toward the top of the can barrel along the can axis O. The tapered part 122 is formed such that the inner surface of the can barrel 12 is inclined to the inside while the plate thickness of the can barrel is increased upward.

Figure 4:
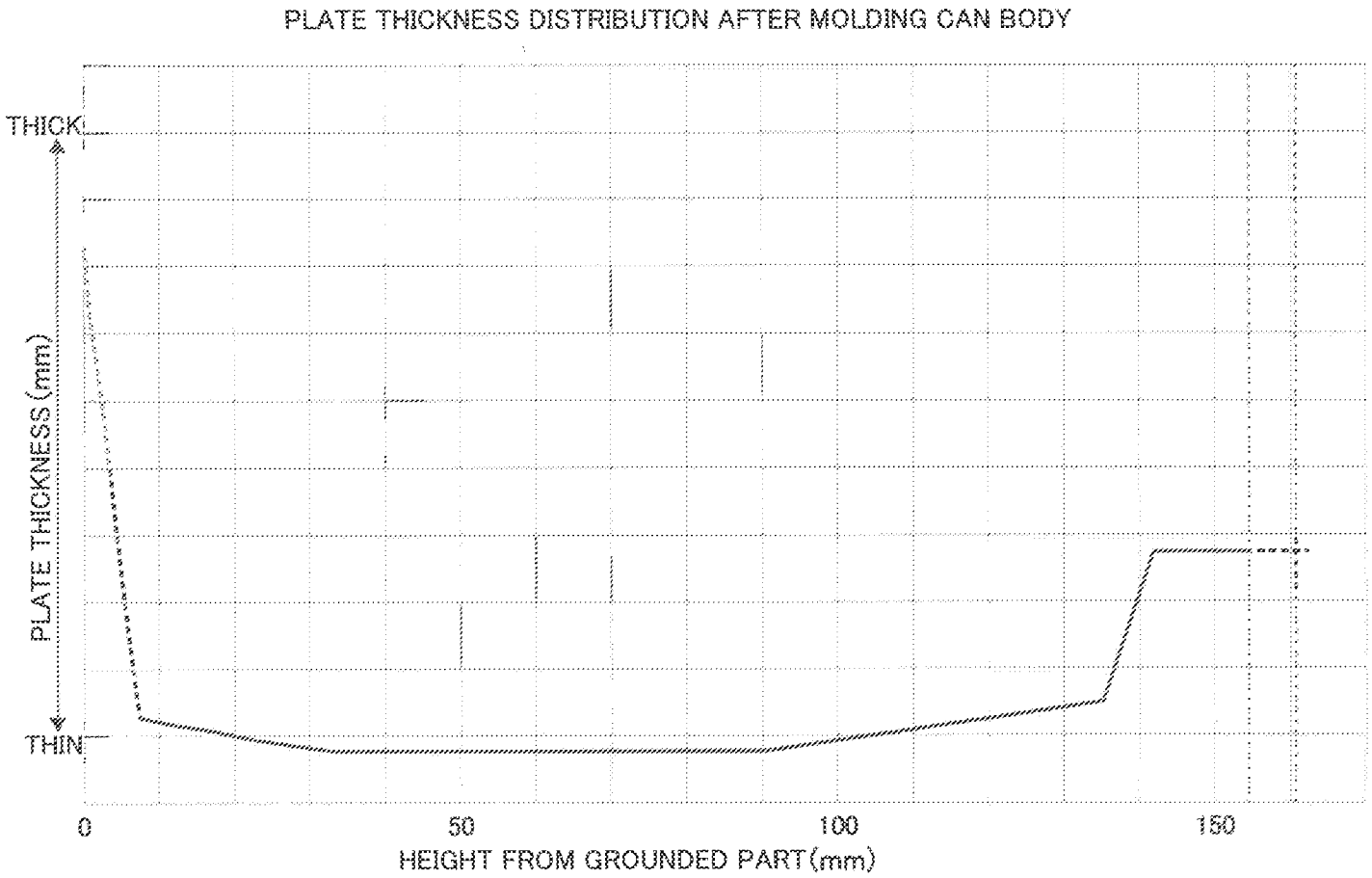
FIG. 4 is a graph illustrating a plate thickness distribution of a can body of the drawn and ironed can made of resin-coated aluminum alloy according to an embodiment of the invention.

With the example illustrated in FIG. 2 and FIG. 3, the can barrel 12 is formed to have a plate thickness which gradually increases around a position of 90 mm from the grounded part 112A of the can bottom 11 toward the upper end of the can barrel 12, and further increases around a position of 135 mm to the neck 121. FIG. 4 illustrates the plate thickness distribution of the can body 10.

As illustrated in FIG. 2 and FIG. 3, the angle of inclination of the tapered part 122 on the inner surface of the can barrel 12, that is, an angle θ2 formed between the tapered part 122 and the straight line parallel to the can axis O is 50 seconds to 1 minute and 30 seconds. In this way, even though the plate thickness of the can body 10 is decreased, the angle of the tapered part 122 is optimized to slow the change in the plate thickness. By this means, it is possible to improve the release property during the stripping, and prevent the can barrel from cracking during the stripping.

FIG. 5 illustrates a result when a can body including a can barrel having an outer diameter of 57.2 mm is molded from a circular plate material having a blank diameter (B.D.) of 143.0 mm, while the angle of the tapered part 122 is changed from 30 seconds to 1 minute and 50 seconds by 10 seconds for each time. In addition, FIG. 6 illustrates a result when a can body including a can barrel having an outer diameter of 57.4 mm is molded from a circular plate material having a blank diameter (B.D.) of 143.0 mm, while the angle of the tapered part 122 is changed from 30 seconds to 1 minute and 50 seconds by 10 seconds for each time.

The tables illustrated in FIG. 5 and FIG. 6 indicate the results when the molding speed is 300 cans per minute, and the original plate thicknesses are 0.22 mm and 0.23 mm for each of the angles of the tapered part 122. In addition, Yes means that the can barrel cracks, and No means that the can barrel does not crack. Here, the numeric values of the original plate thicknesses illustrated in FIG. 5 and FIG. 6 indicate the plate thickness of the aluminum alloy, but does not include the thickness of the outer surface coating resin and the thickness of the inner surface coating resin.

Whether or not the can barrel cracked was evaluated using the ERV (enamel rate value) method. That is, by using an enamel rater, a part to which the metal was exposed was formed in the inner surface of the molded can and an anode is connected to the part; a cathode is immersed in salt solution filled in the can, and a DC voltage of 6V was applied for 4 seconds at a temperature equal to or lower than the room temperature (23 degrees Celsius); and then the current value was evaluated. As to the evaluation criteria, it was evaluated that the can barrel did not crack when the current value was equal to or lower than 60 mA, and that the can barrel cracked when the current value is higher than 60 mA.

Based on the tables illustrated in FIG. 5 and FIG. 6, it is understood that the can barrel cracks during the drawing or during the redrawing when the angle of the tapered part 122 is 40 seconds or less (comparative examples 1-1, 1-2, 2-1, and 2-2), or 1 minute and 40 seconds or more (comparative examples 1-8, 1-9, 2-8, and 2-9). On the other hand, it is understood that the can barrel does not crack during the drawing and during the redrawing when the angle of the tapered part 122 is 50 seconds to 1 minute and 30 seconds (comparative examples 1-3 to 1-7, and 2-3 to 2-7).

As described above, according to the present embodiment, even though the fingers of the stripper apply the load to the opening end of the can barrel 12 during the stripping in the body making step, the tapered part 122 is provided to have the optimum angle with respect to the can axis, and therefore to slow the change in the plate thickness. By this means, it is possible to improve the release property during the stripping, and to prevent the can barrel from cracking even though the plate thickness of the can barrel is decreased.

According to the invention, it is possible to prevent the can barrel from cracking during the stripping.

The invention claimed is:

1. A drawn and ironed can made of resin-coated aluminum alloy comprising a can body having a bottomed cylindrical shape, the can body including:

a can bottom; and a can barrel having a cylindrical shape around a can axis and extending from an outer circumference of the can bottom along the can axis, wherein:

a height of the can body from a grounded part of the can bottom to an upper end of the can barrel is 151 mm to 160 mm;

an outer diameter of the can barrel is 45 mm to 59 mm;

the can barrel includes a tapered part formed in at least part of an area between 90 mm and 135 mm from the grounded part of the can bottom to the upper end of the can barrel, a plate thickness of the can barrel gradually increasing inside the can barrel in the tapered part; and an angle of the tapered part with respect to the can axis is 50 seconds to 1 minute and 30 seconds.

2. The drawn and ironed can made of resin-coated aluminum alloy according to claim 1, wherein:

resin-coated aluminum alloy forming the can body includes outer surface coating resin which forms an outer surface of the can body, inner surface coating resin which forms an inner surface of the can body, and aluminum alloy provided between the outer surface coating resin and the inner surface coating resin;

the can bottom includes a dome part having a concave curved surface provided in a center of the can bottom and being concave into an inside of the can barrel along a direction of the can axis; and in a predetermined region of the dome part including a point on the can axis, a thickness of the outer surface coating resin is 0.008 mm to 0.015 mm, a thickness of the aluminum alloy is 0.18 mm to 0.24 mm, and a thickness of the inner surface coating resin is 0.010 mm to 0.020 mm.

3. The drawn and ironed can made of resin-coated aluminum alloy according to claim 1, wherein:

the can barrel includes a neck provided in an upper end of the can barrel, the neck being formed such that the outer diameter of the can barrel is gradually decreased upward along the can axis;

the neck includes at least a convex curved surface formed in a lower end of the neck and being convex toward an outside in a radial direction, and a concave curved surface formed between the lower end and an upper end of the neck and being concave toward the outside in the radial direction; and an angle of a straight line passing a top of the convex curved surface and a top of the concave surface with respect to the can axis is smaller than 27 degrees.

* * * * *